US006722171B1

(12) United States Patent
Ruan

(10) Patent No.: US 6,722,171 B1
(45) Date of Patent: Apr. 20, 2004

(54) ASSEMBLED LOCK CYLINDER FOR DOOR LOCKS

(75) Inventor: Jiaqiang Ruan, Taishan (CN)

(73) Assignee: Wah Yuet (NG's) Co., Ltd., Kong Kong (CN)

( * ) Notice: Subject to any disclaimer, the term of this patent is extended or adjusted under 35 U.S.C. 154(b) by 0 days.

(21) Appl. No.: 10/316,795

(22) Filed: Dec. 11, 2002

(51) Int. Cl.[7] ..... E05B 17/04
(52) U.S. Cl. ..... 70/379 R; 70/380; 70/371
(58) Field of Search ..... 70/379 R, 380, 70/389, 367–373, 374, 375

(56) References Cited

U.S. PATENT DOCUMENTS

| | | | | | |
|---|---|---|---|---|---|
| 701,850 | A | * | 6/1902 | Cramond | 70/374 |
| 2,381,136 | A | * | 8/1945 | Oxhandler | 70/374 |
| 2,642,735 | A | * | 6/1953 | Quigley | 70/146 |
| 4,550,580 | A | * | 11/1985 | Neyret | 70/370 |
| 4,672,828 | A | * | 6/1987 | Theriault | 70/380 X |
| 4,926,670 | A | * | 5/1990 | DeForrest, Sr. | 70/380 X |
| 5,044,183 | A | * | 9/1991 | Neyret | 70/380 X |
| 5,285,667 | A | * | 2/1994 | Fukasawa et al. | 70/379 R |
| 5,630,332 | A | * | 5/1997 | Aldieri et al. | 70/379 R |
| 5,685,184 | A | * | 11/1997 | Gallagher | 70/358 |
| 5,907,963 | A | * | 6/1999 | Myers et al. | 70/379 R X |
| 5,931,035 | A | * | 8/1999 | Bolton | 70/367 |
| 6,089,059 | A | * | 7/2000 | Fan | 70/371 |
| 6,105,405 | A | * | 8/2000 | Westwinkel | 70/379 R X |
| 6,145,356 | A | * | 11/2000 | Thwing | 70/379 R X |
| 6,185,966 | B1 | * | 2/2001 | Chen | 70/379 R X |
| 6,209,369 | B1 | * | 4/2001 | Freck | 70/375 |
| 6,439,015 | B1 | * | 8/2002 | Sauerland et al. | 70/379 R X |
| 6,446,475 | B1 | * | 9/2002 | Agnatovech et al. | 70/379 R |

* cited by examiner

*Primary Examiner*—Suzanne Dino Barrett
(74) *Attorney, Agent, or Firm*—McAndrews, Held & Malloy, Ltd.

(57) ABSTRACT

An assembled lock cylinder comprises a cylindrical core having a cylindrical outer surface and an end face and defining at least one through hole through the wall of the cylindrical core; a connecting plug having a cylindrical portion inserted into the cylindrical core through the end face and defining at least one pin hole extending inwards from the surface of the cylindrical portion; and at least one pin. The connecting plug has at least one protrusion extended outwards from the outer surface thereof that is inserted into the cylindrical core. The cylindrical core has at least one receiving recess sized to receive the protrusion. When the connecting plug engages the cylindrical core the through hole aligns with the pin hole and the pin can be exactly mounted into the through hole and the pin hole, so the connecting plug cannot move axially and circumferentially with respect to the cylindrical core.

16 Claims, 1 Drawing Sheet

ASSEMBLED LOCK CYLINDER FOR DOOR LOCKS

FIELD OF THE INVENTION

The present invention relates to an element of a lock, particularly to an assembled lock core for a door lock.

BACKGROUND OF THE INVENTION

Lock is a security device applied to openable object and can be unlocked with a key or cipher such as code, timer, automatic switch and magnetic solenoid. There have been various locks disclosed in the art. However, the door lock is the commonest one.

The present door lock generally includes a rotatable lock body, a lock cylinder disposed within the lock body, a slide pin assembly connected with the lock cylinder and the lock body, and a lock bolt driven by the lock cylinder. The lock cylinder has an inner hole at the end far from the key hole, which is engaged with the lock bolt. The inner hole is very difficult to be formed since its structure is complicated. Therefore, the lock cylinder in the prior art is always manufactured as a whole. In general, the lock cylinder made from zinc alloy is integrally die-cast, and then is treated by the process of vacuum galvanization. However, the die-cast piece contains a lot of gas bubbles, it will significantly affect the successive process of the vacuum galvanization. As a result, it is difficult to obtain the lock cylinder with high quality.

SUMMARY OF THE INVENTION

Therefore, the object of the invention is to provide an assembled lock cylinder for a door lock, which comprises:

a cylindrical core having a cylindrical outer surface and an end face, the cylindrical core defining at least one through hole through the wall of the cylindrical core;

a connecting plug having a cylindrical portion that is inserted into the cylindrical core through the end face, the cylindrical portion defining at least one pin hole that extends inwards from the surface of the cylindrical portion; and at least one pin, wherein the connecting plug has at least one protrusion extended outwards from the outer surface thereof that is inserted into the cylindrical core, the cylindrical core has at least one receiving recess sized to receive the protrusion, and when the connecting plug engages the cylindrical core the through hole aligns with the pin hole and the pin can be exactly mounted into the through hole and the pin hole, so that the connecting plug cannot move axially and circumferentially with respect to the cyclindrical core.

In an embodiment of the invention, the number of the through holes is two and that of the pin holes is two as well.

In the present invention, the cylindrical core is preferably made of brass and the surface thereof is preferably treated by vacuum galvanization. The connecting plug is preferably made of zinc alloy.

The assembled lock cylinder according to the invention can efficiently solve the drawbacks in the prior art that the surface of the lock cylinder is difficult to treat. The invention divides the integrated lock cylinder in the prior art into two portions and has the two portions manufactured separately. Also, the two portions are easily assembled. Therefore, the assembled lock cylinder according to the invention can be readily manufactured without changing the function of the lock cylinder but with the higher strength.

DETAILED DESCRIPTION OF THE INVENTION

The present invention will be further described in detail in combination with the drawings.

Figure 1:
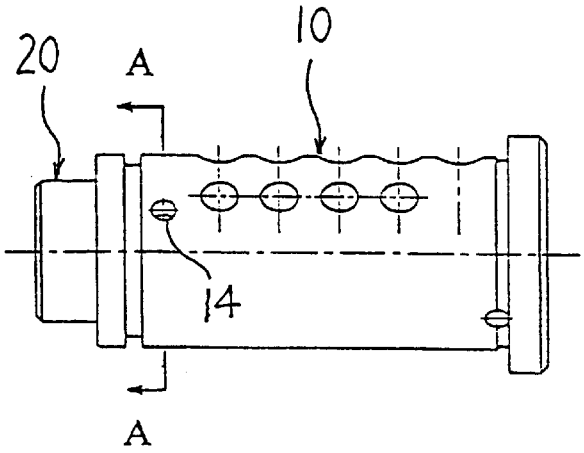
FIG. 1 shows the integral structure of an assembled lock cylinder of the present invention.
Figure 2:
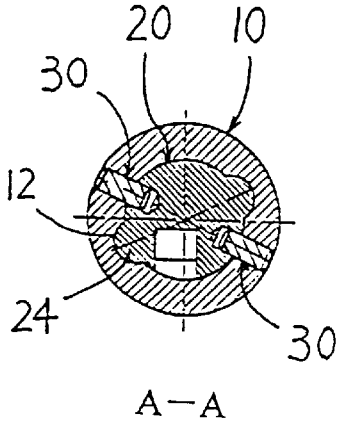
FIG. 2 shows a cross sectional view taken along line A—A as shown in FIG. 1.
Figure 3:
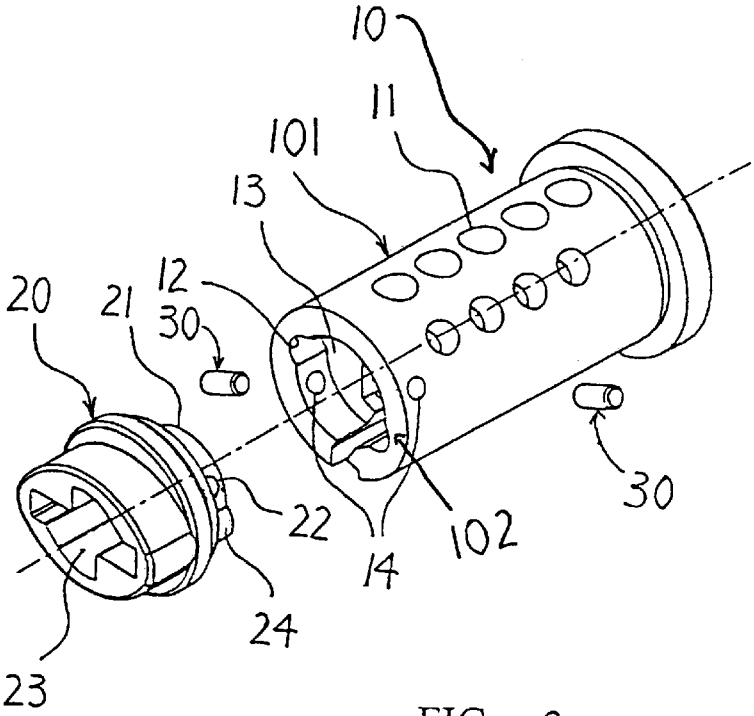
FIG. 3 shows an exploded view of an embodiment of the assembled lock cylinder according to present invention.

Now referring to FIG. 1, an assembled lock cylinder of the invention includes a cylindrical core 10 and a connecting plug 20. As shown in FIG. 3, the cylindrical core 10 has a cylindrical outer surface 101 and an end face 102. The cylindrical core defines two slide pin holes 11 and a key receiving recess to receive the key (not 40 shown). The cylindrical core 10 also defines two through holes 14 through the wall of the cylindrical core.

The connecting plug 20 has a cylindrical portion 21 that can be inserted into the cylindrical core 10 through a connecting opening 13 at the end face 102. The cylindrical portion 21 defines two pin holes 22 that extends inwards from the surface of the cylindrical portion 21.

The cylindrical core 10 has two receiving recesses 12 sized to receive the protrusions 24.

The cylindrical core 10 and the connecting plug 20 in the invention can be therefore manufactured separately. The cylindrical core made of brass can be automatically fabricated and then treated by the process of vacuum galvanization. The connecting plug made of zinc alloy may be fabricated through the die-casting process. This ensures the surface of the lock cylinder to be smooth and lucent and with a higher strength. Additionally, the cylindrical core 10 and the connecting plug 20 can be easily assembled with pins 30.

The connecting plug also defines an eccentric bore 23 extended axially from the other end which is opposite to the end engaged with the lock cylindrical core. The eccentric bore 23 is used for engaging the lock bolt of the door lock (not shown).

Although the present invention and its advantages have been described in detail, it should be understood that various changes, substitutions and alterations can be made herein without departing from the spirit and scope of the invention as defined by the appended claims.

What is claimed is:

1. An assembled lock cylinder for a door lock comprising a cylindrical core having a cylindrical outer surface and an end face, the cylindrical core defining at least one through hole through the wall of the cylindrical core;

a connecting plug defining an eccentric bore extended axially, the connecting plug having a cylindrical portion that engages the cylindrical core through said end face, said cylindrical portion having at least one pin hole that extends inwards from the surface of the cylindrical portion; and at least one pin, wherein said connecting plug has at least one protrusion extended outwards from the outer surface engaged into said cylindrical portion, said cylindrical core has at least one receiving recess sized to receive said protrusion, and when said connecting plug engages said cylindrical core, said through hole aligns with said pin hole and said pin can be exactly mounted into said through hole and said pin hole so that said connecting plug cannot move axially and circumferentially with respect to said cylindrical core.

2. An assembled lock cylinder according to claim 1, wherein the number of said through hole is two, and the two through holes are provided in a line.

3. An assembled lock cylinder according to claim 1, wherein the number of said receiving recess is two, and the two receiving recesses are provided in a line.

4. An assembled lock cylinder according to claim 2, wherein the number of said receiving recess is two, and the two receiving recesses are provided in a line.

5. An assembled lock cylinder according to claim 4, wherein the two receiving recesses are positioned separately with the two through holes.

6. An assembled lock cylinder according to claim 1, wherein said cylindrical core is made of brass and the surface thereof is treated by the process of vacuum galvanization.

7. An assembled lock cylinder according to claim 2, wherein said cylindrical core is made of brass and the surface thereof is treated by the process of vacuum galvanization.

8. An assembled lock cylinder according to claim 3, wherein said cylindrical core is made of brass and the surface thereof is treated by the process of vacuum galvanization.

9. An assembled lock cylinder according to claim 4, wherein said cylindrical core is made of brass and the surface thereof is treated by the process of vacuum galvanization.

10. An assembled lock cylinder according to claim 5, wherein said cylindrical core is made of brass and the surface thereof is treated by the process of vacuum galvanization.

11. An assembled lock cylinder according to claim 1, wherein said connecting plug is made of zinc alloy.

12. An assembled lock cylinder according to claim 2, wherein said connecting plug is made of zinc alloy.

13. An assembled lock cylinder according to claim 3, wherein said connecting plug is made of zinc alloy.

14. An assembled lock cylinder according to claim 4, wherein said connecting plug is made of zinc alloy.

15. An assembled lock cylinder according to claim 5, wherein said connecting plug is made of zinc alloy.

16. An assembled lock cylinder according to claim 6, wherein said connecting plug is made of zinc alloy.

* * * * *